United States Patent [19]

Sano

[11] 4,427,351

[45] Jan. 24, 1984

[54] ROTARY COMPRESSOR WITH NOISE REDUCING SPACE ADJACENT THE DISCHARGE PORT

[75] Inventor: Kiyoshi Sano, Shiga, Japan

[73] Assignee: Matsushita Electric Industrial Co., Ltd., Kadoma, Japan

[21] Appl. No.: 291,932

[22] Filed: Aug. 10, 1981

[30] Foreign Application Priority Data

Sep. 3, 1980 [JP] Japan ..... 55-122627

[51] Int. Cl.[3] ..... F04C 18/00; F04C 29/06; F04B 39/00

[52] U.S. Cl. ..... 418/63; 418/270; 417/540

[58] Field of Search ..... 418/63, 181, 270; 417/540; 91/6.5

[56] References Cited

U.S. PATENT DOCUMENTS 2,153,371 4/1939 Hubacker ..... 418/63
3,056,542 10/1962 Galin ..... 418/63

FOREIGN PATENT DOCUMENTS 44-16620 7/1969 Japan ..... 417/312

*Primary Examiner*—John J. Vrablik
*Attorney, Agent, or Firm*—Wenderoth, Lind & Ponack

[57] ABSTRACT

The disclosure is directed to an improved rotary compressor of a closed type which is provided with a pressure introducing passage communicated at its one end, with a compression space within a cylinder, and at its other end, with a small volume space formed in the cylinder portion for reducing high frequency component in the cylinder inner pressure so as to reduce undesirable noises during operation of the compressor.

4 Claims, 23 Drawing Figures

Figure 1:
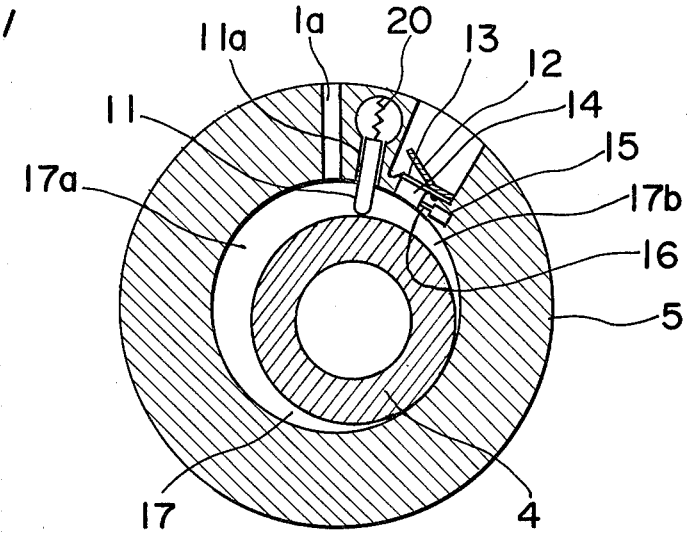

Fig. 5 (a) PRIOR ART
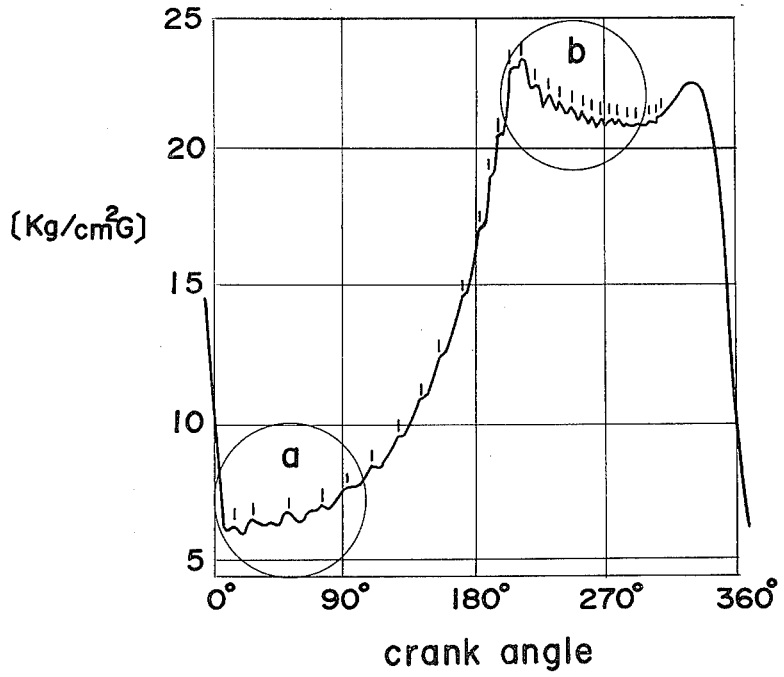
Fig. 5 (b)
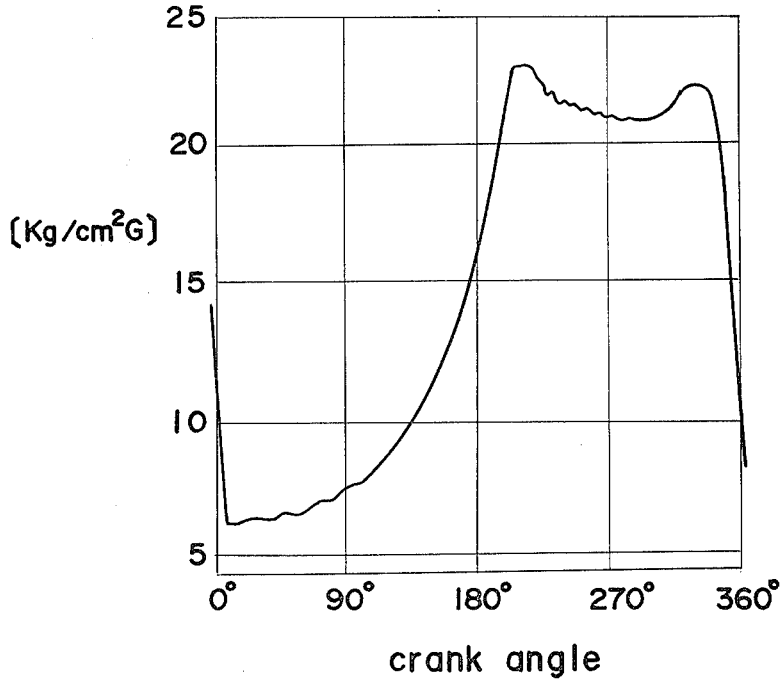

small volume space volume + pressure introducing passage volume/maximum suction volume of cylinder = 0.3% small volume space volume + pressure introducing passage volume/maximum suction volume of cylinder = 0.6 % small volume space volume + pressure introducing passage volume / maximum suction volume of cylinder = 1.4 % small volume space volume+pressure introducing passage volume/maximum suction volume of cylinder = 4.5 %

ROTARY COMPRESSOR WITH NOISE REDUCING SPACE ADJACENT THE DISCHARGE PORT

The present invention generally relates to a compressor, and more particularly to an improved rotary compressor of a closed type which is provided with a pressure introducing passage communicated at its one end with a compression space within a cylinder and at its other end with a small volume space formed in the cylinder portion for reducing a high frequency component in the cylinder inner pressure so as to reduce undesirable noises during operation of the compressor.

Conventionally, for reducing noises produced by rotary compressors, there have been proposed, for example in U.S. Pat. No. 3,857,652, an arrangement in which a silencer or muffler is provided at an outlet of a discharge valve, and in U.S. Pat. No. 4,111,278 another arrangement in which such a silencer or muffler is disposed in a discharge pipe. The known arrangements as described above are generally recognized as effective for reducing noises developed by compressors through damping of jetting noises or whirling noises produced by the discharged refrigerant gas. However, for the pressure pulsation component generated in a cylinder inner chamber, particularly the high frequency component thereof in a region leading to the compression stroke and discharge stroke, there has been provided no suitable solution, in spite of its high noise level and large influence on the compressor noises. Moreover, conventional counter measures against noises are accompanied by undesirable reduction of the compressor capacity, even if applied to the cylinder inner chamber, and thus the applications thereof are limited.

Accordingly, an essential object of the present invention is to provide an improved rotary compressor in which, among the pressure pulsation components within a cylinder inner chamber generated during operating steps such as the intake stroke, compression stroke, discharge stroke, etc., particular attention is directed to the high frequency component of the pressure pulsation in the region of the compression stroke and discharge stroke, and the structure provides means to attenuate said pressure pulsation in a small volume space formed in the vicinity of the discharge port for reducing noises produced by the compressor.

Another important object of the present invention is to provide an improved rotary compressor of the above described type in which, by providing a semi-spherical notch in an end portion of the compression space side of a pressure introducing passage formed in a cylinder, a smooth flow of discharged refrigerant is produced so as not to impair proper performance of the compressor.

A further object of the present invention is to provide an improved rotary compressor of the above described type in which, by selecting the volume of the small volume space to be an optimum value, noises are reduced without lowering the compressor performance.

In accomplishing these and other objects, according to one preferred embodiment of the present invention, there is provided a closed type rotary compressor which comprises a closed housing, a motor and a compressor mechanism driven by the motor which are provided in the closed housing, the compressor mechanism being a cylindrical piston movably provided in a cylinder, a partition plate provided in the cylinder for selective protrusion from or retraction into the cylinder so as to divide the compression space defined between the inner wall of the cylinder and the peripheral surface of the piston into a compression side and a suction side, and bearing and plates secured to opposite ends of the cylinder for closing the cylinder, a discharge port for compression refrigerant in the cylinder and a discharge valve for selective opening or closing of the discharge port. Either one or both of the cylinder and the bearing end plates have, at the end face thereof, a small volume space having a volume smaller than the maximum suction volume of the cylinder and a pressure introducing passage communicating the small volume space with the compression space in the vicinity of the discharge port, the pressure introducing passage having cross-sectional area smaller than that of the small volume space.

By the arrangement according to the present invention as described above, an improved rotary type compressor which is highly efficient in operation yet which produces little noise has been advantageously provided, and the disadvantages inherent in the conventional rotary compressor of this kind have been substantially eliminated.

Figure 2:
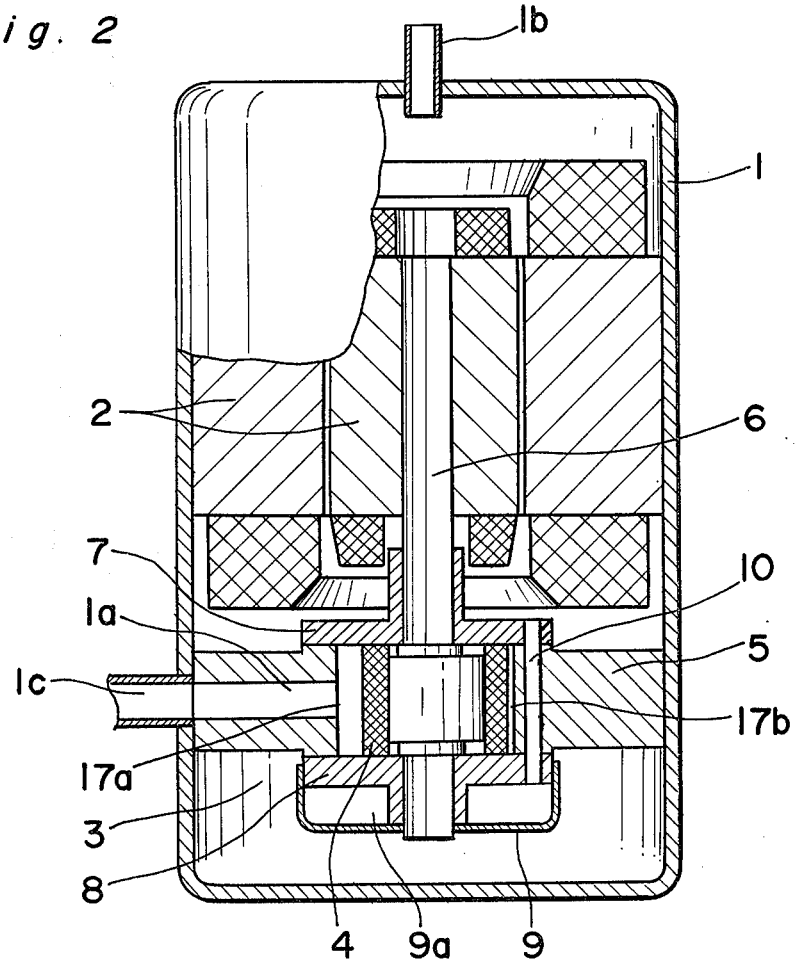
Figure 3:
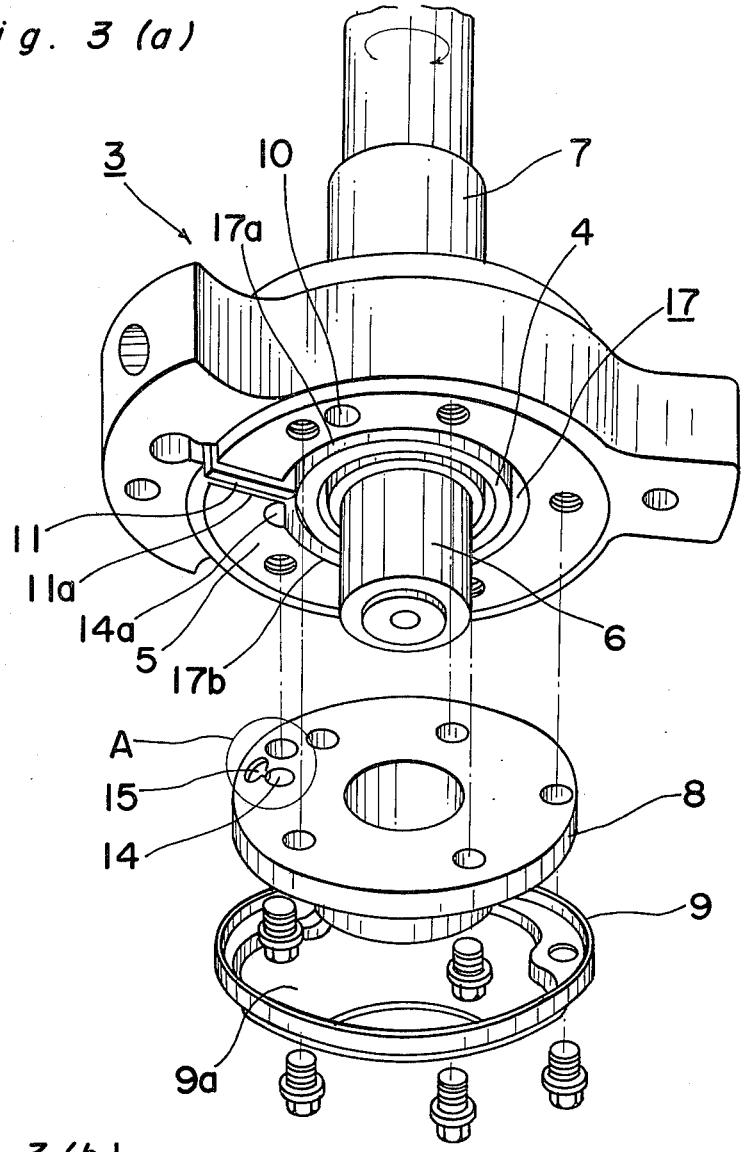
Figure 3:
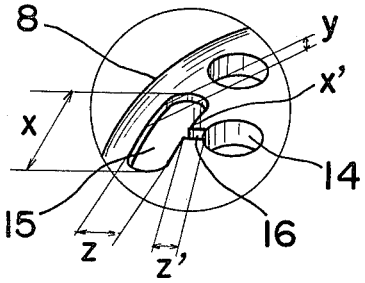
Figure 4:
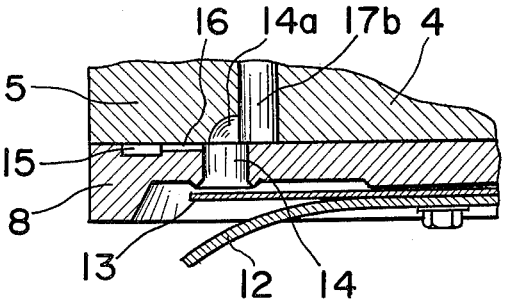
Figure 6:
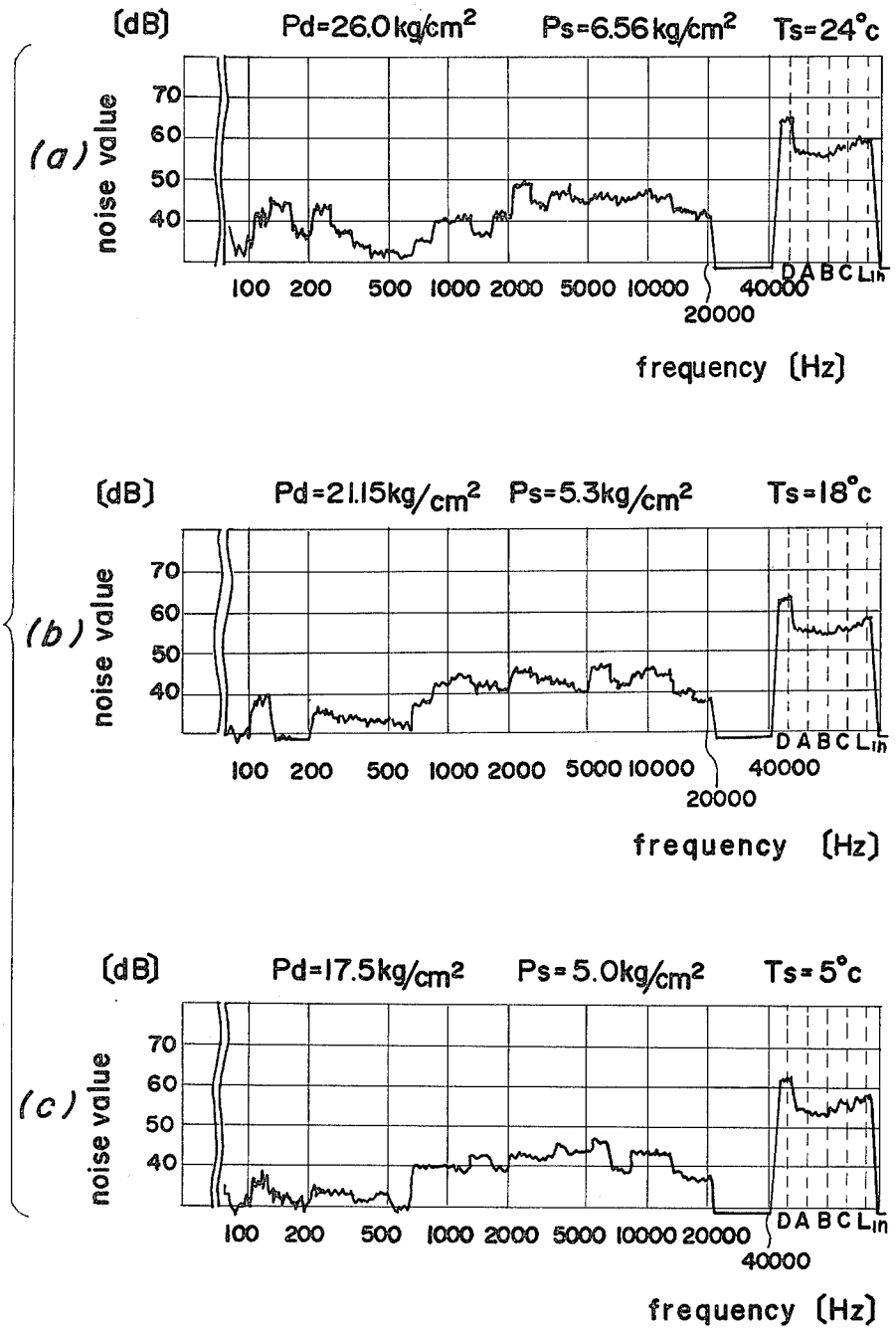
Figure 7:
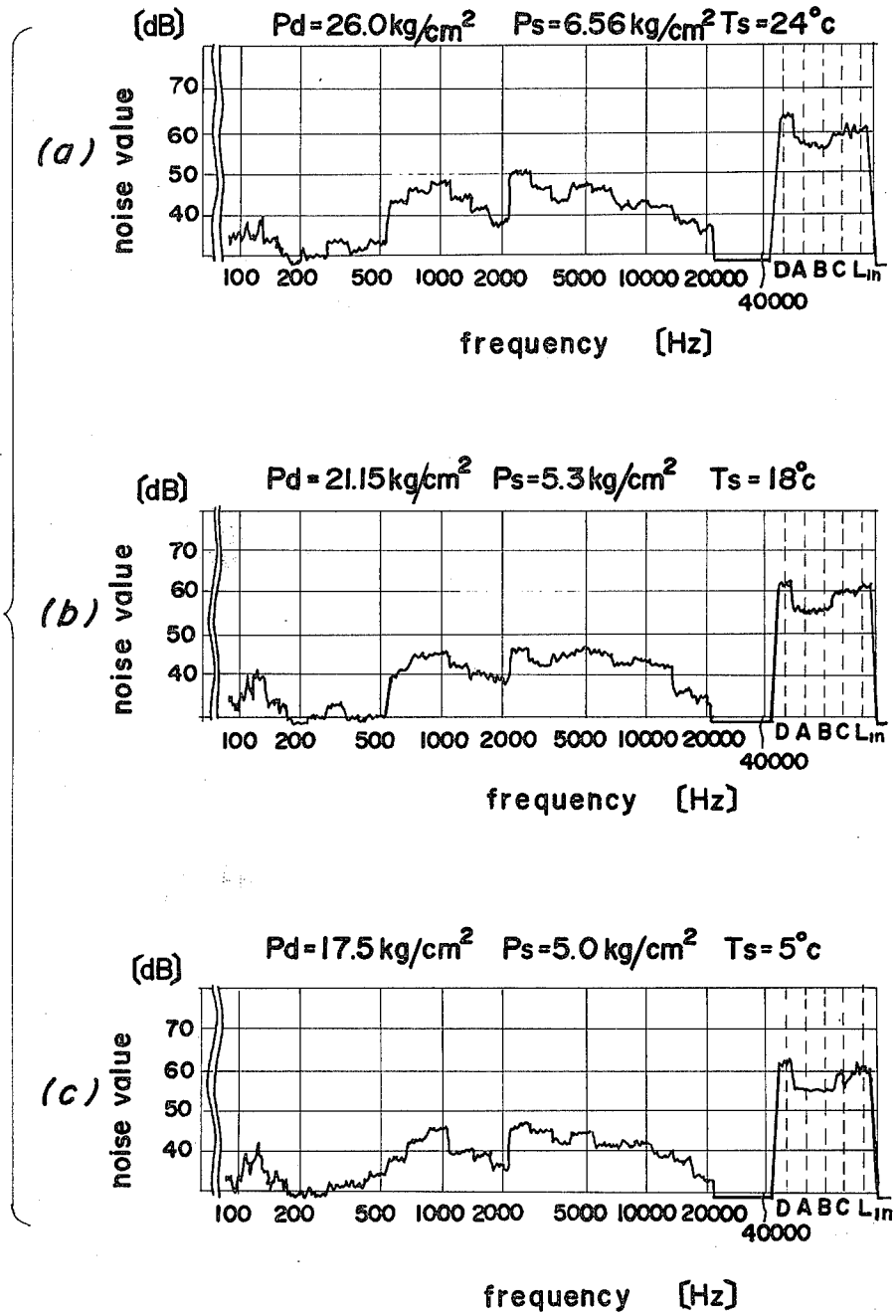
Figure 8:
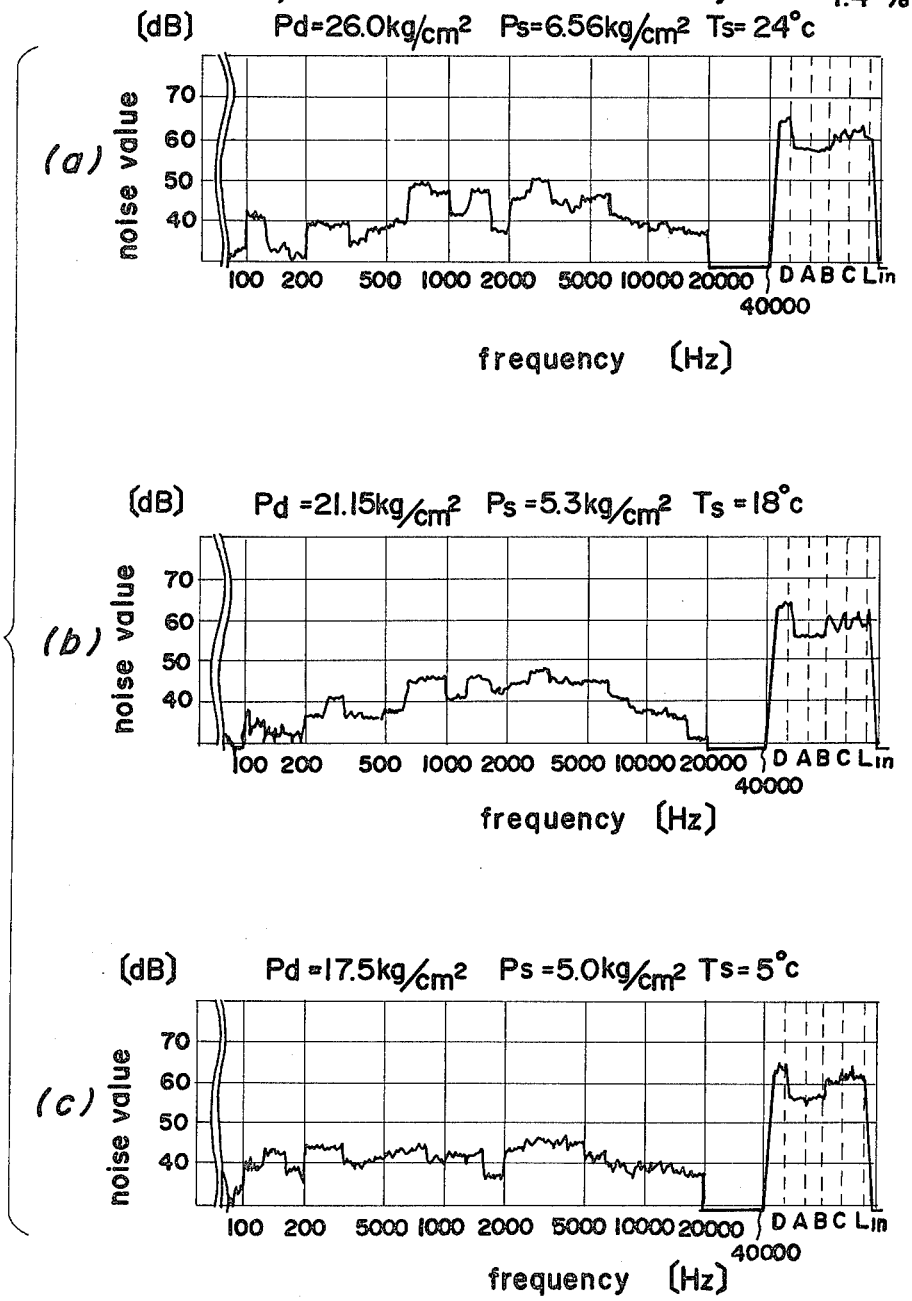
Figure 9:
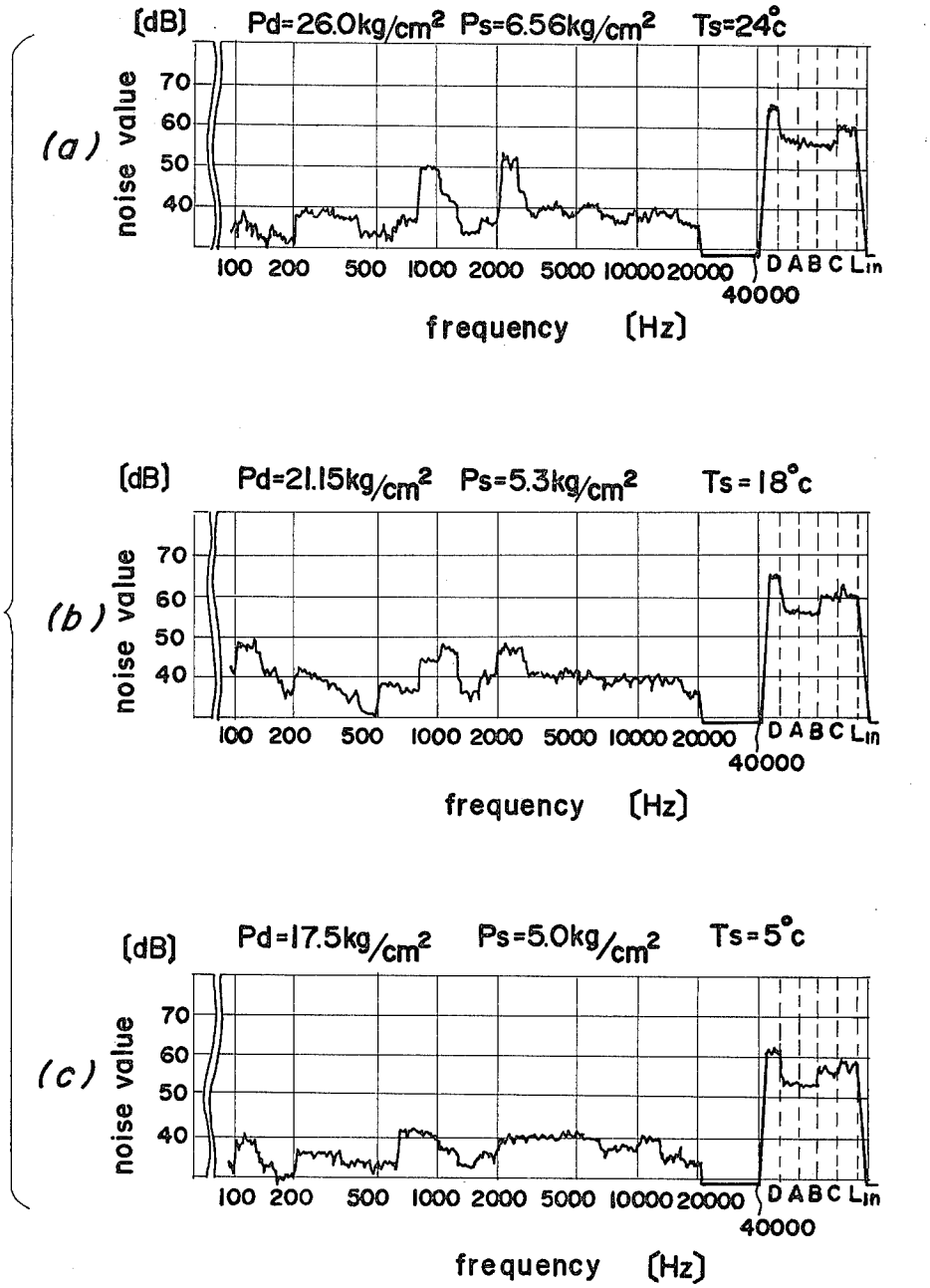
Figure 10:
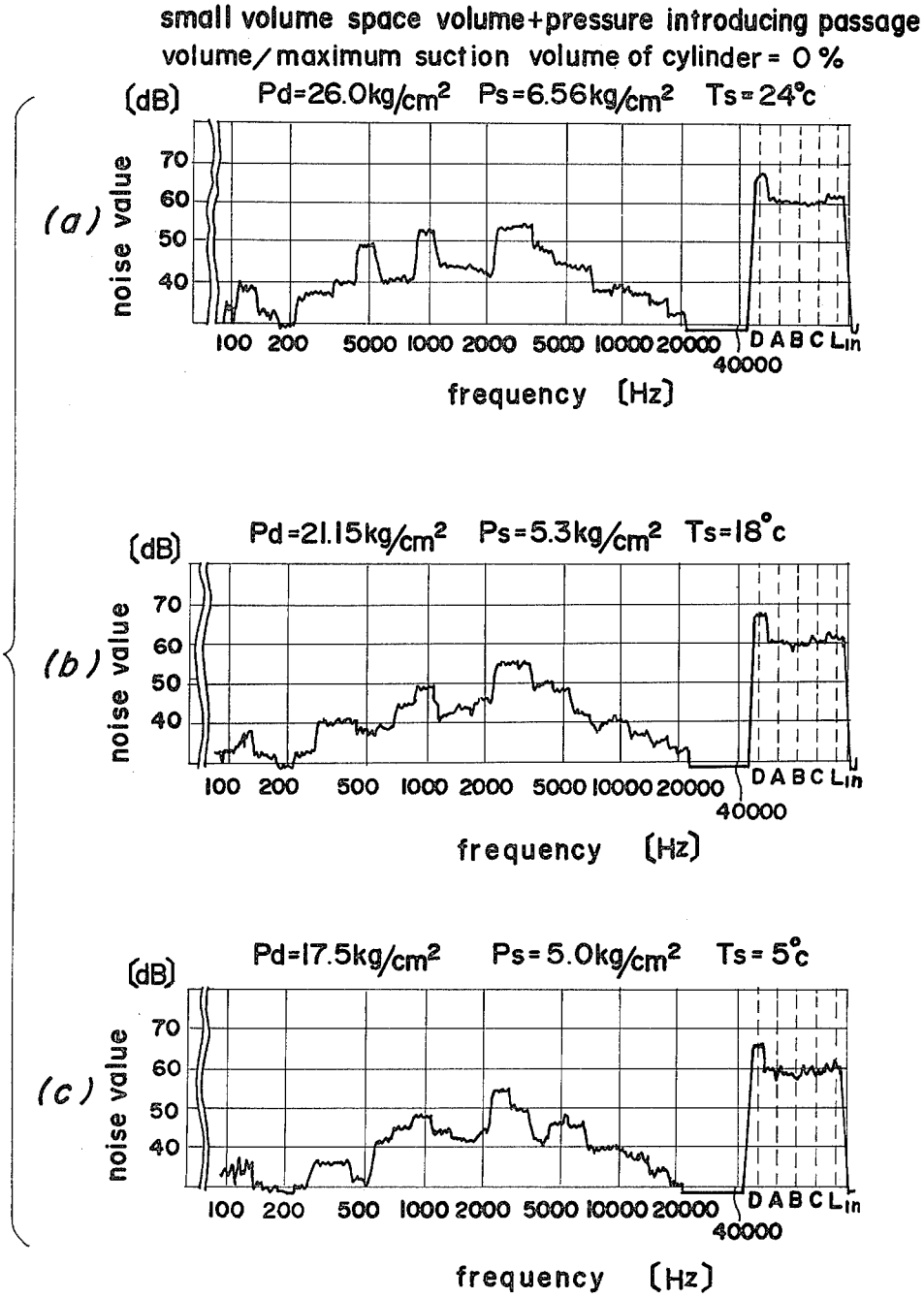
Fig. 10 PRIOR ART
Figure 11:
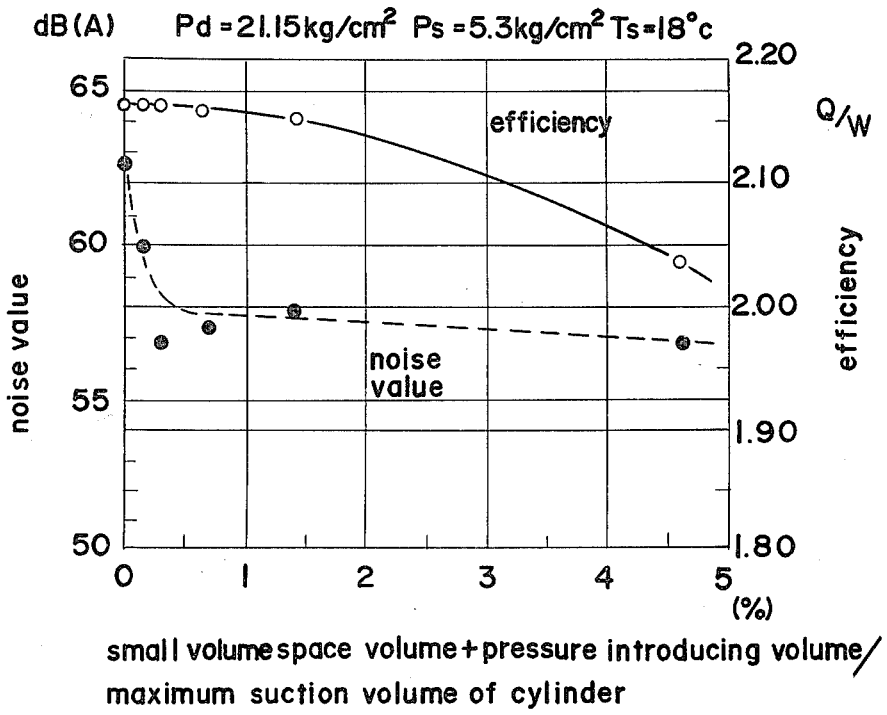

These and other objects and features of the present invention will become apparent from the following description of a preferred embodiment thereof with reference to the accompanying drawings, in which;

FIG. 1 is a schematic transverse sectional diagram explanatory of the operating principle of a closed type rotary compressor according to the present invention, FIG. 2 is a side elevational view, partly broken away and in section, showing the construction of a closed type electrically driven rotary compressor according to one preferred embodiment of the present invention, FIG. 3(*a*) is an exploded view of a compressor mechanism employed in the rotary compressor of FIG. 2, FIG. 3(*b*) is a fragmentary perspective view showing, on an enlarged scale, the portion A in the arrangement of FIG. 3(*a*), FIG. 4 is a fragmentary sectional view of the discharge port portion in the arrangement of FIG. 3(*a*), FIGS. 5(*a*) and 5(*b*) are pressure diagrams taken at the compression side of the compression space for a conventional compressor and the compressor according to the present invention, respectively, FIGS. 6(*a*), 6(*b*) and 6(*c*), FIGS. 7(*a*), 7(*b*) and 7(*c*), FIGS. 8(*a*), 8(*b*) and 8(*c*), and FIGS. 9(*a*), 9(*b*) and 9(*c*) are noise analysis diagrams for a rotary compressor with an output of 750 W according to the present invention, respectively, FIGS. 10(*a*), 10(*b*) and 10(*c*) are diagrams similar to FIGS. 6(*a*) through 9(*c*), which particularly relate to a conventional rotary compressor having a 750 W output, and FIG. 11 is a diagram showing the relations among the ratio of the small volume space to the maximum suction volume of the cylinder, noise, and efficiency in the 750 W rotary compressor according to the present invention.

Before the description of the present invention proceeds, it is to be noted that like parts are designated by like reference numerals throughout several views of the accompanying drawings.

Referring now to the drawings, the principle of the present invention will be explained hereinbelow with reference to FIG. 1.

In FIG. 1, the compressor mechanism of a rotary compressor according to the present invention generally includes a cylinder 5 having a suction port 1*a*, discharge port 14, a discharge valve 13 and a stop 12 therefor provided in the discharge port 14 in a known manner, a pressure introducing passage 16 having its one end communicated with the discharge port 14 and its other end leading to a space 15 of a small volume formed in the cylinder 5 in a position adjacent to said discharge port 14, and a piston 4 rotatably accommodated in a cylinder space 17 within the cylinder 5. A partition plate 11 which divides the interior of the cylinder 5 into a suction side 17*a* communicated with the suction port 1*a* and into a compression side 17*b* communicates with the discharge port 14 is slidably received in a groove 11*a* in one portion of the cylinder 5. Additionally, a spring 20 is disposed inside the groove 11*a* for the partition plate 11 and urges one edge of the plate 11 into close contact with the peripheral face of the piston 4. Moreover, bearing-type flanges (not shown here) which support a driving shaft (not shown here) and block opposite end openings of the cylinder 5 are, respectively, provided at both ends of the cylinder 5.

In the above arrangement, rotational variation of the piston takes place at the compression region, due to uneven thickness of a layer of lubricating oil around the piston 4, the magnitude of frictional force which the peripheral surface of the piston 4 engages the partition plate 11, and variation in frictional torque through changes in direction, etc. The rotational variation of the piston 4 as described above varies the compression force to cause pressure pulsation. Similarly, variation in the irregular viscous flow in the mixed oil and gas in the refrigerant in the cylinder 5 induces a large pressure variation in the cylinder inner pressure. In addition, the pressure pulsation is increased by standing resonance inside the cylinder 5 and jet streams caused at the discharge port 14 during the discharge stroke.

However, since a pressure pulsation buffer construction, which is formed by the pressure introducing passage 16 in communication with the discharge port 14 and the small volume space 15, is provided in the region of the discharge port 14 where the above-described phenomena are noticed, the pressure pulsation energy produced within the cylinder can be advantageously attenuated.

An electrically driven rotary type compressor according to the present invention will be described hereinbelow with reference to FIGS. 2 to 4.

In FIGS. 2 through 4, the rotary compressor generally comprises a closed container or housing 1 having a suction pipe 1*c* and a discharge pipe 1*b*, and a motor section 12 of a known construction, and the compressor mechanism 3 driven by the motor section 2, all of which are accommodated in said closed container 1.

More specifically, the compressor mechanism 3 further includes the cylinder 5 which is open at its opposite ends and in which the piston 4 rotatably fitted on one portion of a driving shaft 6 is accommodated. Additionally, at one portion of the cylinder 5, the partition plate 11 is received in the groove 11*a* formed in the cylinder wall so as to be selectively extended from or retracted into the groove 11*a* for dividing the space 17 in the cylinder 5 into a compression side 17*b* and an intake or suction side 17*a*, and a spring member (not shown here) is disposed within the groove 11*a* to normally urge one side edge of the partition plate 11 into close contact with the corresponding peripheral face of the piston 4. Moreover, at the opposite ends of the cylinder 5, an upper bearing end plate 7 and a lower bearing end plate 8, each being a sintered molded plate adapted to support the driving shaft 6 and to close the end portions of the cylinder 5 are respectively provided. There is further provided a discharge gas passage 10 in the cylinder 5 which opens, at its one end, inside the closed container 1, while the discharge port 14 is formed in the lower bearing end plate 8, and is communicated with the compression side 17*b* of the compression space located within the cylinder 5. The discharge valve 13 and discharge valve stop 12 are respectively disposed at the discharge end of the discharge port 14. Furthermore, in the cylinder 5, a discharge notch or recess 14*a* is formed into a quarter spherical shape with one side opening into the compression side 17*b* and the other side opening into the discharge port 14 so that the smooth flow of the discharged refrigerant can be achieved. Additionally, a small volume space 15 is formed in the side face of the lower bearing end plate 8 contacting the cylinder 5 and is communicated with the discharge port 14 through a pressure introducing passage 16. The small volume space 15 and the pressure introducing passage 16 may in the end face of the cylinder 5 or in both the end face of the lower bearing end plate 8 and the end face of the cylinder 5. In the above arrangement, the total volume of the small volume space 15 and the pressure introducing passage 16 is approximately 0.6% of the maximum suction volume (approximately 13.63 cc) of the cylinder 5. The maximum suction volume of the cylinder 5 referred to above means the suction volume at a time when the partition plate 11 has been retracted to complete refrigerant discharge in the rolling piston type compressor. It should be noted, however, that, in the volume relationship between the small volume space 15 and the pressure introducing passage 16, the small volume space 15 makes up most of the volume and the volume of the pressure introducing passage 16 may be neglected in the actually measured volume. Namely, in the present embodiment, it is arranged so that the width x of the small volume space 15 is approximately 10 mm, the depth y thereof is approximately 1.5 mm, and the length z thereof is approximately 5 mm as shown in FIG. 3(*b*), while the width x' (cross-sectional area) of the pressure introducing passage 16 is a semicircle of 1.5 mm in diameter and the length z' thereof is approximately 2.5 mm. Therefore, it will be understood that the volume of the pressure introducing passage 16 is extremely small as compared with the volume of the small volume space 15 and may be neglected. Accordingly, the volume of the pressure introducing passage 16 will be neglected in the following description. There is further provided a discharge muffler 9 formed into a dish-like configuration so as to cover the corresponding surface of the lower bearing end plate 8, and having a muffler space 9*a* formed therein. The discharge port 14 described ealier is communicated with the discharge gas passage 10 through the muffler space 9*a*.

By the above arrangement, when the motor portion 2 is driven, the refrigerant in a refrigerating system of a known construction is drawn in through the suction port 1*a* from the suction pipe 1*c* during rotation of the piston 4, and flows from the suction side 17*a* of the cylinder 5 into the compression side 17*b* where the refrigerant is compressed. The refrigerant passes through the discharge recess 14*a* provided in the cylinder 5 and through the discharge port 14 provided in the lower bearing end plate 8 to raise the discharge valve 13 and is released into the space 9*a* of the discharge muffler 9. The refrigerant is then directed into the closed container 1 through the discharge gas passage 10 provided in the cylinder 5 and is discharged again from the discharge pipe 1*b* into the refrigerating system.

In connection with the above, it has been a disadvantage in the conventional arrangements that when the compressed refrigerant gas raises the discharge valve 13 so as to be rapidly discharged from the compression side 17*b* of the compression space or when the compressed refrigerant gas remaining in the discharge port 14 or the discharge recess 14*a* is rapidly discharged into the refrigerating gas in the suction side 17*a* of the compression space, pressure pulsation of comparatively high frequency is developed in the suction side 17*a* and the compression side 17*b* of the space 17 inside the cylinder as shown in the portion A and the portion B of FIG. 5(*a*), thus giving rise to large noises of the compressor.

However, in the embodiment of the present invention, since the small volume space 15 and the pressure introducing passage 16 connecting the small volume space 15 with the discharge port 14 are respectively formed near the portion of the sinter-molded bearing end plate 8 which comes into contact with the cylinder 5, the pressure pulsation which is noticed in the conventional arrangements is relieved as shown in FIG. 5(*b*).

The noise characteristics of a compressor having the construction as described hereinabove and of a conventional compressor will be described hereinbelow.

With reference to a compressor having a 750 W output, the noise characteristics of such a compressor having a construction according to the present embodiment are shown in FIG. 7, while those of such a compressor having a conventional construction are shown in FIG. 10. In the noise characteristics shown in FIGS. 7(*a*), (*b*), (*c*) and FIGS. 10(*a*), (*b*), (*c*), the operating conditions of the compressors is somewhat changed according to the conditions of NEW-JIS (Japanese Industrial Standard). More specifically, under the NEW-JIS conditions, respective pressures and temperatures are, for example, so prescribed that discharge pressure $Pd=21.15$ kg/cm$^2$, suction pressure $Ps=5.3$ kg/cm$^2$, suction temperature $Ts=18°$ C., and supercooling temperature $Sc=0°$ C. FIGS. 7(*b*) and 10(*b*) show measured results for these conditions and FIGS. 7(*a*) and 7(*c*) show actually measured results, respectively, where the conditions have been increased above and reduced below the above-described conditions (discharge pressure Pd, suction pressure Ps, suction temperature Ts, and supercooling temperature Sc). The speed of rotation of the compressor is approximately 3,450 rpm.

As a result, the noise has been reduced over a wide range of 500 Hz through 20,000 Hz. The volume of the small volume space 15 for the compressor of the present invention is as described earlier.

The volume of the small volume space 15 was changed for further experiments, with results as shown in FIG. 6, FIG. 8 and FIG. 9.

As is seen from these results, the noise has been lowered over the wide range of 500 Hz through 20,000 Hz.

In the compressor having the above construction, when the volume of the small volume space 15 is increased, the noise reducing effect may be improved, but on the contrary, the rate of power consumption of the motor with respect to the amount of the refrigerant gas discharged from the compressor is increased. Therefore, in the present embodiment, it has been found that if the volume of the small volume space 15 is made to approximately 0.6% of the maximum suction volume of the cylinder, the power consumption of the motor with respect to the amount of the refrigerating gas discharged hardly changes as compared with a compressor which is not provided with the small volume space 15.

Furthermore, upon investigation, through experiments, into the range of volume of the small volume space 15 which the compressor can have for actual practical application, for a possible range of operating conditions of the compressor in terms of the rate of power consumption of the motor with respect to the amount of refrigerant gas discharged, the results as shown in the diagram of FIG. 11 have been obtained, in which noise value [dB/A] and efficiency Q/W are plotted on the ordinate, while the ratio in percentage of the small volume space to the maximum suction volume of the cylinder is given on the abscissa.

As a result, the volume range of the small volume space 15 for a consumption power of the compressor which can ensure proper operation during actual use is approximately 0.3 through 5% of the maximum suction volume of the cylinder, in which range efficiency reduction of the compressor is small yet there is, an appreciable reduction of noises.

It should be noted here that the dimensions of the above-described small volume space 15 represented by x, y and z and the dimensions of the pressure introducing passage 16 represented by x′ and z′ described earlier for denoting the volumes relate to one of the embodiments of the present invention, including work errors, etc. Accordingly, such dimensions are not always accurate, but will serve as a standard by which the relationship of the size of the small volume space 15 and the pressure introducing passage 16 may be judged. Meanwhile, the influences exerted upon the noises by the entrance area of the pressure introducing passage 16, which has been neglected in the foregoing description have been studied. As a result, it has been found that, within a workable range, as the entrance area becomes larger, i.e. as said area approaches the cross-sectional area represented by ( $x \times y$) of the small volume space 15, the noise characteristics will deteriorate, while as the entrance area of the pressure introducing passage 16 becomes smaller than the area ($x \times y$) of the small volume space 15, better noise characteristics are provided. From the above results, it will be understood that the entrance area may be neglected part of the volume of the space which serves for reduction of the noises as described hereinabove. The cross-sectional configuration of the pressure introducing passage 16, described as semi-circular in the foregoing description, may be modified, for example into a square cross-sectional configuration, with no unfavorable effect on the noise characteristics, from which it will be understood that no significant influence will be exerted by the shape of the pressure introducing passage 16 upon the noise characteristics. However, the cross-sectional configuration of the entrance passage should preferably be semi-circular or square for facilitating manufacturing, etc.

In the results of the experiments as described in the foregoing, noise variation caused by altering the ratio of the small volume space 15 to the maximum suction volume of the cylinder may be barely confirmed with ears. Particularly, the direction of deterioration can be comparatively easily ensured. On the other hand, in the experiments involving changing the entrance area and the cross-sectional configuration of the pressure introducing passage 16, the variation of noise was such that it could not be confirmed by the sense of hearing.

Therefore, in the present invention, changing the ratio of the maximum suction volume of the cylinder to the volume of the small volume space is most effective for the reduction of noises, and the following conditions must be satisfied.

(I) The volume of the small volume space should be in the range of 0.3 through 5% of the maximum suction volume of the cylinder.

(II) The cross-sectional area of the pressure introducing passage is required to be smaller than the cross-sectional area ($x \times y$) of the small volume space.

It will be understood that, by selecting optimum numerical values according to the performance characteristics of the compressor based on the above conditions, reduction of noises can be achieved.

Accordingly, by providing the small volume space 15 and the pressure introducing passage 16 having a small cross-sectional area adjacent to the discharge port 14, in the end face of the cylinder 5 or in the contact face of the lower bearing end plate 8 which comes into contact with the end face of the cylinder 5, with the volume of the small volume space 15 being in the range of 0.3 through 5% of the maximum suction volume of the cylinder, the extremely large reduction of noises can be achieved without impairing the performance of the compressor. Moreover, since the small volume space 15 and the pressure introducing passage 16 are open to said contact face, only minor additional manufacturing steps are required, and therefore, the compressor of the present invention can be manufactured at approximately the same cost as that of the conventional compressor. Moreover, since automation may be introduced for the forming of the small volume space and the pressure introducing passage, the construction is extremely simple, and thus, the resultant compressor is not required to be made large in size.

It should be noted here that, in the foregoing embodiment, although the present invention has been mainly described with reference to a rolling piston type compressor, the concept of the present invention is not limited to the rolling piston type compressor alone, but may readily be applied, for example, to a vane type rotary compressor which has a partition plate projectable and retractable with respect to the piston for similar suction, compression and discharge of the refrigerant.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A closed type rotary compressor which comprises a closed housing, a motor and a compressor mechanism driven by said motor which are provided in said closed housing, said compressor mechanism having a cylindrical piston member eccentrically movably provided in a cylinder member, a partition plate member provided in said cylinder member for selective protrusion from and retraction into said cylinder member so as to divide the cylinder space defined between the inner wall of said cylinder member and the peripheral surface of said piston member into a compression side and a suction side, and bearing end plates secured to opposite ends of said cylinder member for closing the ends of said cylinder member and one of said end plates being provided with a discharge port for compressed refrigerant and a discharge valve for selective opening and closing of said discharge port, at least one of said cylinder member and said one bearing end plate having in the end face thereof a small volume space separate from said cylinder space and having a volume smaller than the maximum suction volume of said cylinder and a pressure introducing passage means, said pressure introducing passage means having one end communicating with said small volume space and the other end communicating with said compression space in the vicinity of said discharge port, said pressure introducing passage means having a cross-sectional area smaller than that of said small volume space.

2. A closed type rotary compressor as claimed in claim 1, wherein the volume of said small volume space is within a range of 0.3 to 5.0% of maximum suction volume of said cylinder.

3. A closed type rotary compressor as claimed in claim 1, wherein said cylinder member has a quarter hemispherical passage therein from said compression side to said discharge port, and said pressure introducing passage means opens into said quarter hemispherical passage adjacent said discharge port.

4. A closed type rotary compressor as claimed in claim 3, wherein the volume of said small volume space is within a range of 0.3 to 5.0% of maximum suction volume of said cylinder.

* * * * *